US007134158B2

(12) United States Patent
Tokarz

(10) Patent No.: US 7,134,158 B2
(45) Date of Patent: Nov. 14, 2006

(54) PORTABLE, ADJUSTABLE, INFLATABLE BED

(76) Inventor: Marilyn Theresa Tokarz, 7138 Hagar Shore Rd., Coloma, MI (US) 49038

( * ) Notice: Subject to any disclaimer, the term of this patent is extended or adjusted under 35 U.S.C. 154(b) by 0 days.

(21) Appl. No.: 11/194,355

(22) Filed: Aug. 1, 2005

(65) Prior Publication Data

US 2006/0021146 A1 Feb. 2, 2006

Related U.S. Application Data

(60) Provisional application No. 60/598,077, filed on Aug. 2, 2004.

(51) Int. Cl.
*A47C 27/08* (2006.01)

(52) U.S. Cl. ..... 5/632; 5/633; 5/732; 5/615; 5/733; 5/734

(58) Field of Classification Search ..... 5/706, 5/710, 722, 723, 731–734, 615, 632–634, 5/657, 922, 925, 652, 655.3; 297/352, 382, 297/440.11
See application file for complete search history.

(56) References Cited

U.S. PATENT DOCUMENTS 3,935,604 A 2/1976 Collins
4,382,306 A * 5/1983 Lickert ..... 5/710
4,685,163 A * 8/1987 Quillen et al. ..... 5/710
4,802,249 A * 2/1989 Bills ..... 5/420
4,941,221 A * 7/1990 Kanzler ..... 5/615
4,949,409 A 8/1990 Stefano
5,170,522 A 12/1992 Walker
D348,792 S 7/1994 DeGroot
5,970,545 A * 10/1999 Garman et al. ..... 5/615
5,970,550 A 10/1999 Gazes
6,298,511 B1 10/2001 Collymore
6,823,545 B1 * 11/2004 Davis ..... 5/630
6,848,137 B1 * 2/2005 Barnes ..... 5/710
7,020,918 B1 * 4/2006 Tinsley ..... 5/632

* cited by examiner

*Primary Examiner*—Michael Trettel
(74) *Attorney, Agent, or Firm*—Invention Protection Associates, LLC

(57) ABSTRACT

A bed apparatus having a base and two inflatable members for elevating the torso and legs of a user is provided. The inflatable members are removably attachable to the base and can be selectively spaced apart, making the bed spatially adjustable. The extent to which a user's body is elevated is controlled by inflation of the inflatable members, making the bed vertically adjustable.

6 Claims, 3 Drawing Sheets

PORTABLE, ADJUSTABLE, INFLATABLE BED

This nonprovisional application claims the benefit of provisional application 60/598,077, filed Aug. 2, 2004.

BACKGROUND OF THE INVENTION

The present invention generally relates to an inflatable bed and is specifically directed to an air inflatable bed apparatus that, when not inflated, is compactable for efficient portability and storage and that includes removably attachable elevated support components that are vertically and spatially adjustable so as to make the apparatus adjustable for optimum comfort and compatible with users of different physical dimensions.

Vertically adjustable beds are well known commodities. Today, most American hospital rooms are equipped with vertically adjustable beds that are electromechanically operable. Hospitalized patients who are confined to those types of beds, but who remain physically capable of controlling the beds without assistance can, at the mere press of a switch, incline their beds and raise themselves to watch television, converse with visitors and perform various other waking activities that are preferably done from upright postures. Similarly, the patients can then decline the beds and lower themselves whenever they wish to assume a more evenly horizontal position. Furthermore, vertically adjustable beds allow bedridden patients in more debilitated conditions to be raised, by their care providers, to facilitate basic activities such as feeding and bedpan use or for preventing fluid buildup in the patients' lungs without the patients having to be physically handled by multiple care providers. Therefore, in addition to enabling patients to have more comfortable hospitalization experiences, vertically adjustable beds can effectively lower a hospital's labor costs by reducing the number of care personnel that otherwise would be needed simply for lifting and lowering debilitated patients on their beds throughout the day.

From a negative standpoint, however, a contemporary electromechanical bed that is vertically adjustable can be simply too expensive for the average consumer to purchase for home use. Also, as is the case with any electromechanical device, there are risks of mechanical or electrical failure occurring. Furthermore, the sheer sizes and weights of most of these beds make it prohibitive to move them from room to room, much less transport them in vehicles.

Air inflatable beds, some of which are vertically adjustable, are also well known in the prior art. For examples, U.S. Pat. No. 6,298,511 to Collymore and U.S. Pat. No. 5,170,522 to Walker both disclose examples of such. Inflatable beds, generally, can provide multiple benefits to users. One obvious benefit, depending on the construction of the particular airbed, is that of portability. Airbeds which are compactable and devoid of any heavy or rigid parts, as are many vinyl-fabricated air mattresses, can be transported for use virtually anywhere, and their compactness allows them to be easily stored in small spaces.

Another virtue of an inflatable mattress, in comparison to a conventional bed mattress, can be the firmness that the inflatable mattress possesses when it is inflated to a high pressure. For this reason, an inflatable bed may be preferable to a more forgiving conventional mattress for a person suffering from a chronic back ailment. And an airbed that is contoured to smoothly incline a user's torso can be a considerably firmer inclined lying surface than is an inclinable conventional mattress, much less the makeshift alternative of stacked pillows for propping the head and torso. Again, for users suffering from back or neck problems, the extra firmness of the airbed can be essential to preventing further spinal and muscular aggravation. Additionally, persons suffering respiratory ailments such as asthma or emphysema and those suffering gastric problems such as acid reflux disease ("GERD") can also benefit from an airbed that elevates their torsos during rest.

However, inflatable beds of the prior art are not without their deficiencies as well. One such deficiency common to many known inflatable beds is their lack of spatial adjustability. To wit, since people of varying tallness may wish to enjoy the use of an inflatable bed, it may be necessary to allow for expansion and contraction of, for example, the space that separates the torso/head elevating segment of the airbed from its leg elevating segment, where the inflatable bed features both such segments. When an inflatable bed does not allow for this kind of spatial adjustment, the bed may be incompatible with users who are considerably taller than the typical user, as the legs of taller users may extend beyond the end of the airbed, or the leg incline segment of the airbed may not be comfortably situated relative to its torso/head incline segment. Incidentally, this inability to adjust the spacing between inclined segments of the bed is not confined to inflatable beds; it can be a drawback of mechanical adjustable beds as well.

Thus, it can be appreciated that there exists a particular need for a portable bed apparatus that is both vertically and horizontally adjustable to enable lifting and propping of the torsos and legs of users and to render it compatible with virtually all users. The portable, adjustable and inflatable bed of the present invention substantially fulfills this need.

SUMMARY OF THE INVENTION

In view of the foregoing disadvantages inherent in inflatable beds of the known prior art, the present invention discloses a new inflatable bed for providing adjustable lift support to its users. In a preferred embodiment, the present invention comprises a base member and two attachable lifting members. The first and second lifting members are for elevating and supporting a user's torso and legs, respectively, and the base member integrates the lifting members and provides a means for selectively spacing them apart.

All of the member components are fabricated of durable material—the lifting members being adapted to support the weight of a human body when they are inflated with air. The base member comprises simply a rectangular sheet of the material. Located at opposite ends of the base member's top surface are patches of hook and loop fasteners. On the bottom surface of the base are strips of rubberized material for preventing the base from sliding along the floor or bed mattress that it is placed upon.

When they are inflated with air, the first lifting member is contoured to lift a user's torso, while the second lifting member is contoured to elevate and support a user's legs. The bottom surfaces of each lifting member (i.e., the sides to not be in contact with the user's body) have long strips of hook and loop fasteners for engagement with the patches of hook and loop fasteners located at opposite ends of the base member's use surface, and the lifting members' respective bottom surfaces also feature rubber strips that prevent the lifting members from sliding. The fastener strips on the bottoms of the lifting members are considerably longer than the fastener patches atop the base member's use surface. In fact, the lengths of the lifting members' fastener strips allow the lifting members to be attached to the base member at varying distances from each other so that the lifting members may be selectively spaced for optimum individual user comfort.

The present invention can be greatly beneficial to, not only people confined to beds, but others who may be afflicted with various physical ailments. For example, acid reflux very often occurs while a person is in lying position since it is easy for the stomach contents to spill into the esophagus when the torso is horizontal and those body parts are level. By inclining the user's torso such that the user's esophagus is vertically above his stomach, the present invention substantially diminishes the possibility of reflux occurring. For another example, people suffering from edema, or swelling of the feet and legs, can reduce their swelling while sleeping by using the second lifting member to elevate their legs vertically above their hearts. And because the present invention is so easily transportable, it can be taken along during travel and used anywhere.

Therefore, it is an object of the present invention to provide a bed apparatus that is air inflatable, making the bed vertically adjustable. The extent to which the apparatus's lifting members will incline a user's torso or lift a user's legs is directly dependent on the extent to which the lifting members are inflated with air. The vertical attitude of a user's lying body can be adjusted by simply using an air pump to inject air or allowing air to expel through a closeable hole that is along each lifting member. Therefore, when the deflated bed apparatus sits underneath the body of a bedridden user, the user can be effectively raised into an upright posture to read, watch television or enjoy a meal without any physical labor by inflating the lifting members. Likewise, the user can be subsequently lowered my simply opening the lifting members' holes and releasing the air.

It is another of the present invention to provide a bed apparatus that is spatially adjustable. The present bed apparatus can be effectively lengthened or shortened by selective attachment of the lifting members to the base member. The bottom surfaces of the lifting members have linear strips of fasteners allowing the lift members to attach to the base member at varying distances from one another.

It is an object of the present invention to provide an inflatable bed that is exceptionally comfortable for a user to rest upon. To this end, the use surfaces of the base and lifting members are upholstered with a plush fabric so that a user's skin need not be in contact with sweat inducing vinyl. For maintaining cleanliness and sanitation without undue labor, removable fabric covers may be snugly placed atop the lifting members similar to a fitted sheet found on a conventional mattress. After bed usage, such covers can be removed and machine-washed before being refitted over their respective lifting members.

It is yet another object of the present invention to provide an adjustable bed apparatus that is easily portable and efficiently storable. By including no frames, solid walls or other rigid parts and, instead, incorporating collapsible lifting members with a base member capable of being folded up or coiled, the entire apparatus can be compacted into a small bundle and carried by an individual, transported in and automobile, packed inside a closet, etc. The present bed can be unfurled, inflated and used in places that mechanical adjustable beds, as well as some inflatable beds of the prior art, could not be taken or fitted.

DETAILED DESCRIPTION OF THE PREFERRED EMBODIMENTS

Figure 3:
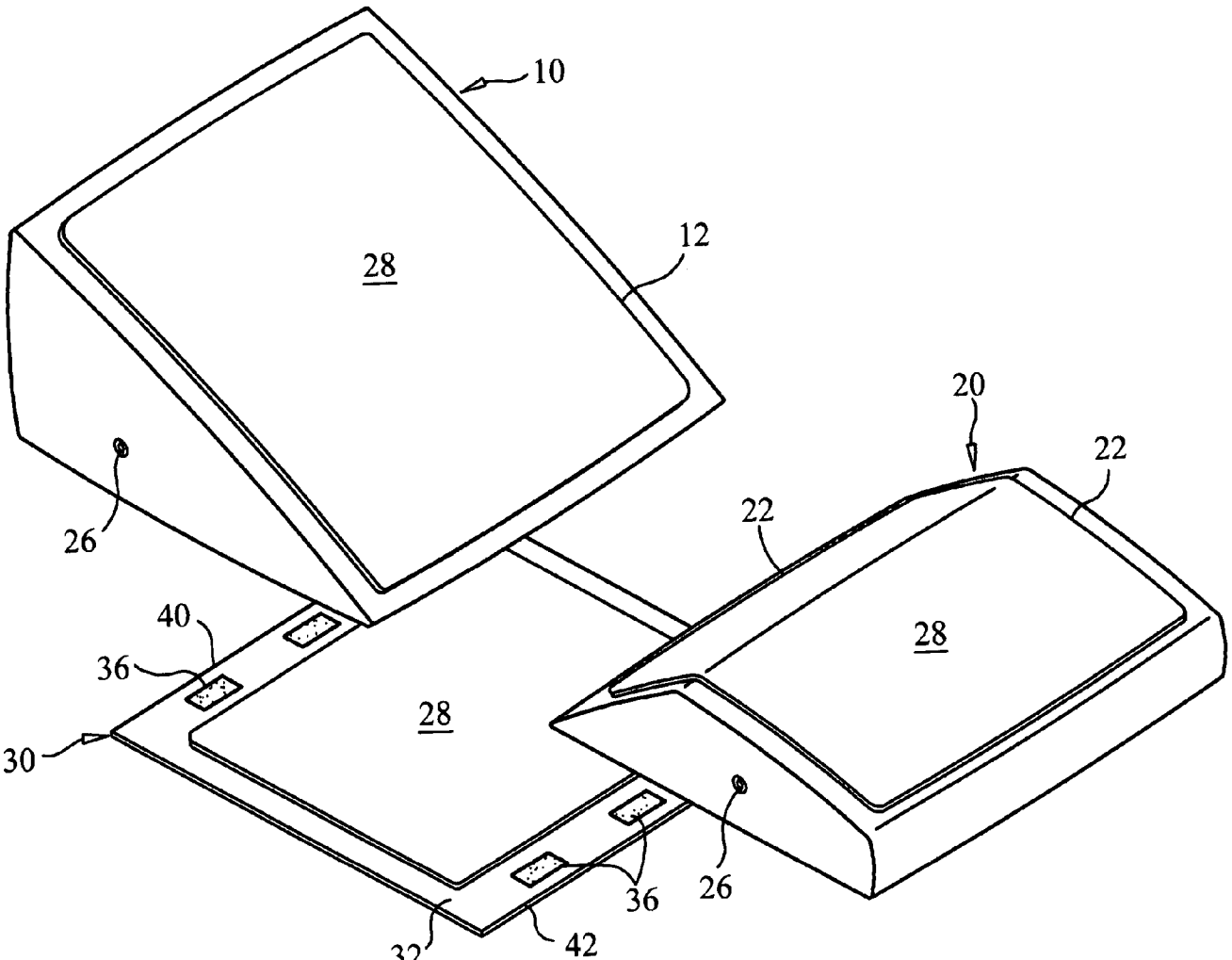
FIG. 3 is a top perspective view of the portable, adjustable, inflatable bed showing the bed components detached from one another.
Figure 4:
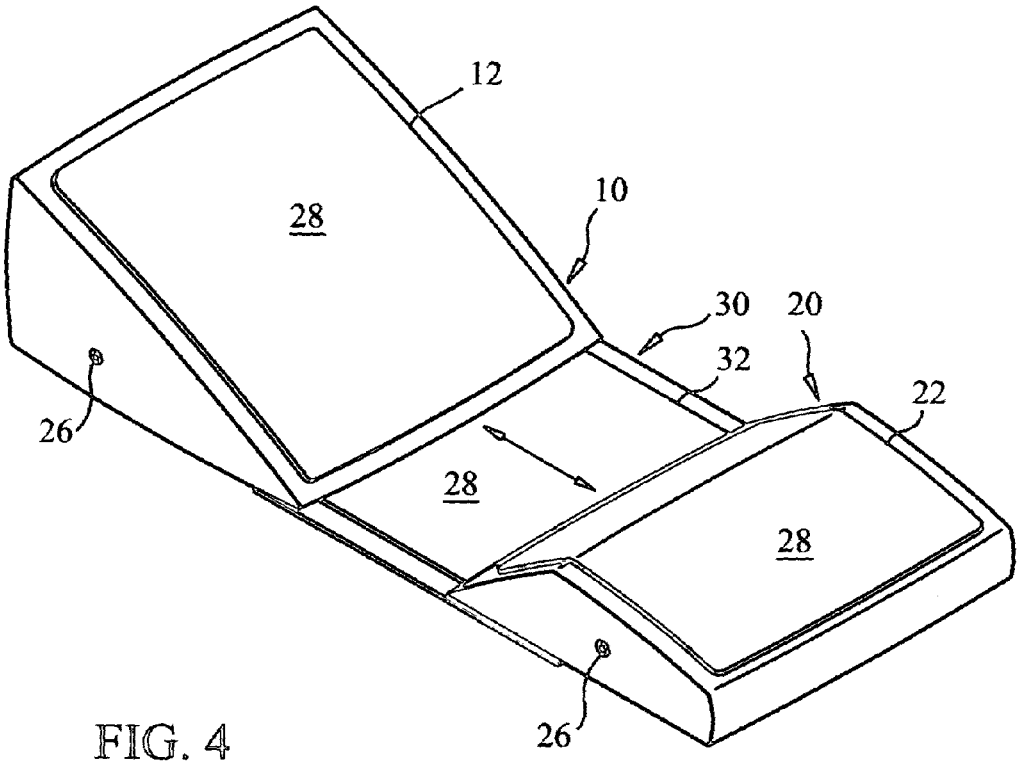
FIG. 4 is a is a top perspective view of the portable, adjustable, inflatable bed showing the bed assembled.

A preferred embodiment of the portable, adjustable, inflatable bed of the present invention is illustrated in FIGS. 3 and 4. That embodiment of the bed includes three integrated primary components: a base member 30, a first lifting member 10 and a second lifting member 20.

Figure 1:
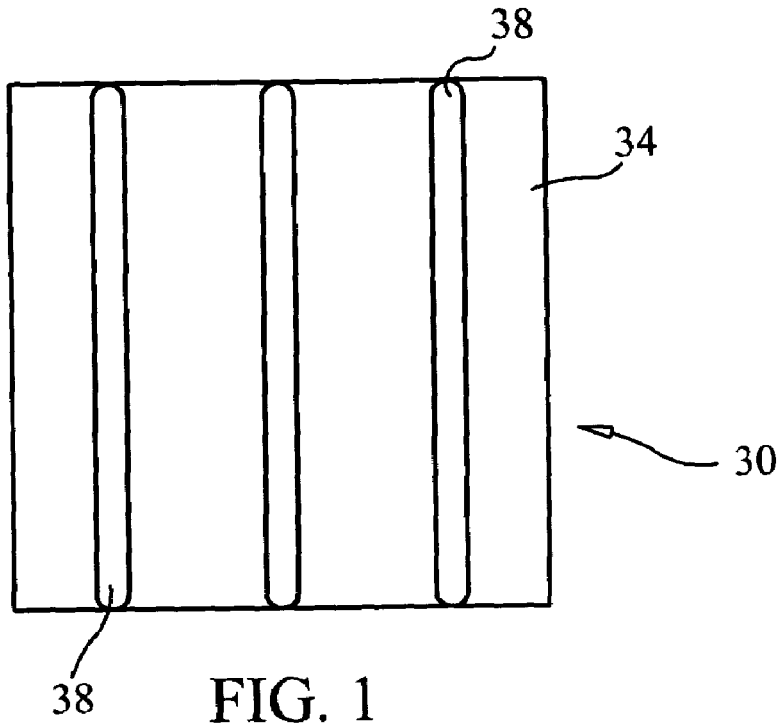
FIG. 1 is a bottom plan view of the base member.
Figure 2:
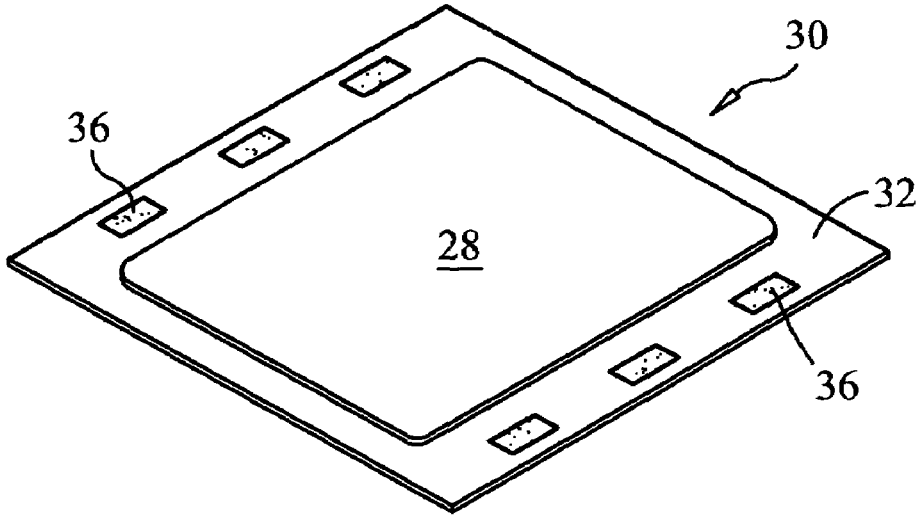
FIG. 2 is a top perspective view of the base member.

The base member 30 comprises a substantially flat and rectangular slab of durable material such as vinyl. On its use surface 32 are short strips of hook and loop fasteners 36 running generally adjacent to both its proximal end 40 and its distal end 42, as illustrated in FIG. 2. On its bottom surface 34 are strips of rubber 38, as illustrated in FIG. 1. These rubber strips 38 are particularly useful when the base member is sitting atop a slick bed sheet or floor surface, as the strips 38 help to prevent the base member 30 from sliding. For the user's comfort, velour 28 upholsters the base member's use surface 32, although velvet or other types of soft textile materials could suffice as well.

Figure 5:
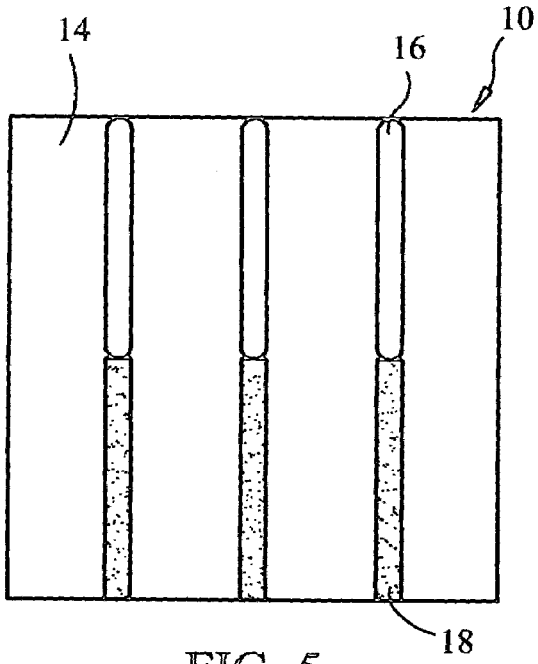
FIG. 5 is a bottom plan view of the first lifting member only.
Figure 6:
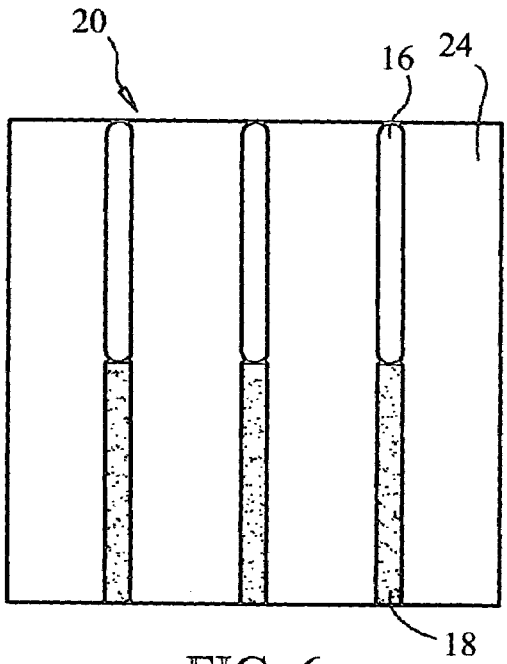
FIG. 6 is a bottom plan view of the second lifting member only.

The first lifting member 10 and second lifting member 20 are generally hollow and collapsible compartments. In a preferred embodiment, the lifting members 10 and 20 are primarily comprised of a durable and air impermeable material such as vinyl. Velour 28 layers the first lifting member's use surface 12 as well as the second lifting member's use surface 22. A closeable hole 26 of a type that could be found on any inflatable bed is located along a perimeter side of each lifting member. The first lifting member's bottom surface 14 and the second lifting member's bottom surface 24 are virtually identical. Both bottom surfaces 14 and 24 feature long strips of hook and loop fasteners 18 as well as rubber strips 16 like the rubber found along the base member's bottom 34. The lifting members' bottom surfaces 14 and 24 are illustrated in FIGS. 5 and 6, respectively.

When the first lifting member 10 is fully inflated with air, as is depicted in FIGS. 3 and 4, the lifting member 10 takes on a five-sided wedge shape contoured for a user's head and torso to comfortably rest upon. Similarly, when the second lifting member 20 is inflated, the lifting member 20 takes on a wedge shape contoured to comfortably fit underneath a user's legs and allow the user's feet to rest vertically below his slightly bent knees. The second lifting member 20 depicted in FIGS. 3 and 4 illustrates such a shape. However, the second lifting member 20 can have other contours.

To inflate either lifting member with air, one must simply: (1) open the particular lifting member's hole 26; (2) inject air through the hole 26 either orally or, preferably, with an air pump (not shown); and (3) close the hole 26 to trap the injected air inside the lifting member. As much air as necessary should be injected into the first lifting member 10 to create the proper inflation pressure for supporting the user's torso at a desired vertical incline and into the second lifting member 20 to lift the user's legs to a desired height. If a user is lying atop the bed of the present invention while its lifting members 10 and 20 are in collapsed condition, inflating lifting member 10 will effectively raise the user's torso, and inflating lifting member 20 will elevate the user's legs.

Conversely, as air is allowed to release from the first lifting member 10 via its opened hole 26, the angle of vertical incline formed by the inflated lifting member 10 is correspondingly decreased. The height of the second lifting member 20 is similarly lowered when its hole 26 is opened and air is expelled. In fact, when they are fully deflated and in collapsed condition, the lifting members 10 and 20 may have generally unrecognizable form, and they can be folded and compressed into small masses.

The bed of the present invention is fully assembled when the hook and loop fasteners 36 near the base member's proximal end 40 are attached to the corresponding hook and loop fasteners 18 found along the first lifting member's bottom surface 14 while the fasteners 36 near the base member's distal end 42 are attached to the corresponding fasteners 18 found along the second lifting member's bottom surface 24. An assembled bed apparatus is illustrated in FIG. 4. The separation distance between the lifting members 10 and 20 is dependent upon where along their respective fastener strips 18 the base member's fasteners 36 are engaged. Thus, while one may vertically adjust the bed by virtue of controlling the inflation level of the lifting members 10 and 20, one may also horizontally adjust the bed by selectively attaching the lifting members 10 and 20 to the base member 30.

I claim:

1. A portable, adjustable, inflatable bed comprising:

a base member having a use surface, a bottom surface, a proximal end and a distal end, wherein the base member's use surface has hook and loop fasteners situated generally near both its proximal and distal ends;

an air inflatable and collapsible first lifting member, wherein the first lifting member is generally wedge-shaped and contoured to prop the torso of a lying user when it is fully inflated and has a use surface and a bottom surface, wherein the first lifting member's bottom surface has strips of hook and loop fasteners for engagement with the fasteners situated generally near the proximal end of the base member, whereby the first lifting member is removably attachable to the base member; and an air inflatable and collapsible second lifting member, wherein the second lifting member is contoured to prop the legs of a supine lying user when it is fully inflated and has a use surface and a bottom surface, wherein the second lifting member's bottom surface has strips of hook and loop fasteners for engagement with the fasteners situated generally near the distal end of the base member, whereby the second lifting member is removably attachable to the base member.

2. The bed of claim 1, wherein said first lifting member and said second lifting member are fabricated from an air impermeable material.

3. The bed of claim 2, wherein said air impermeable material is vinyl.

4. The bed of claim 1, wherein the respective bottom surfaces of the base member, first lifting member and second lifting member have strips of rubberized material for preventing those members from sliding relative to foreign surfaces that they may rest upon.

5. The bed of claim 1 wherein the respective use surfaces of the base member, first lifting member and second lifting member are upholstered with a soft textile for making those members more comfortable for a user to rest upon.

6. The bed of claim 5, wherein said soft textile is velour.

* * * * *